US009733604B2

(12) United States Patent
Sato

(10) Patent No.: US 9,733,604 B2
(45) Date of Patent: Aug. 15, 2017

(54) IMAGE FORMING APPARATUS, METHOD FOR CONTROLLING THE SAME, AND STORAGE MEDIUM STORING PROGRAM

(71) Applicant: CANON KABUSHIKI KAISHA, Tokyo (JP)

(72) Inventor: Masayuki Sato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/085,245

(22) Filed: Nov. 20, 2013

(65) Prior Publication Data

US 2014/0147133 A1 May 29, 2014

(30) Foreign Application Priority Data

Nov. 29, 2012 (JP) ..... 2012-261629

(51) Int. Cl.
*G03G 15/00* (2006.01)

(52) U.S. Cl.
CPC ..... *G03G 15/55* (2013.01); *G03G 15/502* (2013.01)

(58) Field of Classification Search
USPC ..... 399/12, 81
See application file for complete search history.

(56) References Cited

U.S. PATENT DOCUMENTS 4,870,526 A * 9/1989 Maruta et al. ..... 361/1
5,539,499 A * 7/1996 Fujisawa ..... 399/9
5,602,625 A * 2/1997 Okamoto ..... G03G 15/55 399/21
6,430,711 B1 * 8/2002 Sekizawa ..... 714/47.2
8,010,009 B2 * 8/2011 Mochizuki ..... H04N 1/00408 399/81
8,040,542 B2 * 10/2011 Oda et al. ..... 358/1.14
8,099,613 B2 * 1/2012 Suzuki ..... 713/320
(Continued)

FOREIGN PATENT DOCUMENTS

JP H08-220946 A 8/1996
JP 2003-118881 A 4/2003
(Continued)

OTHER PUBLICATIONS

Japanese office action issued in corresponding application No. 2012-261629 dated Aug. 8, 2016.

*Primary Examiner* — Clayton E LaBalle
*Assistant Examiner* — Linda B Smith
(74) *Attorney, Agent, or Firm* — Carter, DeLuca, Farrell & Schmidt, LLP

(57) ABSTRACT

The image forming apparatus sequentially displays, based on the identification code stored in the storage unit, an image showing an operational procedure necessary to clear the maintenance event and then an image that prompts to close a cover corresponding to the maintenance event, on a display unit. The identification code stored in the storage unit is deleted in a case where the maintenance event is cleared. The image forming apparatus displays an image that prompts to close the cover, without displaying an image showing an operational procedure necessary to clear the maintenance event identified with the identification code, in a case where the identification code is stored in the storage unit at the time of start of the image forming apparatus.

13 Claims, 12 Drawing Sheets

(56) References Cited

U.S. PATENT DOCUMENTS

| | | | | |
|---|---|---|---|---|
| 8,391,740 | B2 * | 3/2013 | Ogasawara | G03G 15/5016 361/679.07 |
| 8,451,468 | B2 * | 5/2013 | Soda | H04N 1/32609 358/1.1 |
| 9,036,173 | B2 * | 5/2015 | Thomas | H04N 1/00015 358/1.12 |
| 2004/0136732 | A1 * | 7/2004 | Okamoto et al. | 399/9 |
| 2007/0196149 | A1 * | 8/2007 | Sato et al. | 399/360 |
| 2007/0201884 | A1 * | 8/2007 | Yamada | G03G 15/70 399/21 |
| 2008/0181639 | A1 * | 7/2008 | Yokomizo | G03G 15/2064 399/68 |
| 2008/0239386 | A1 * | 10/2008 | Yanagi | G06F 11/0733 358/1.15 |
| 2009/0103937 | A1 * | 4/2009 | Kudo | 399/80 |
| 2011/0194143 | A1 * | 8/2011 | Yamaguchi | G03G 15/5079 358/1.15 |
| 2012/0155943 | A1 * | 6/2012 | Taki et al. | 399/401 |
| 2012/0230709 | A1 * | 9/2012 | Sakaguchi | 399/27 |
| 2012/0287457 | A1 * | 11/2012 | Ishii | G03G 15/502 358/1.14 |
| 2013/0004193 | A1 * | 1/2013 | Park et al. | 399/69 |

FOREIGN PATENT DOCUMENTS

| | | | |
|---|---|---|---|
| JP | 2004-233583 | A | 8/2004 |
| JP | 2007-336290 | A | 12/2007 |

* cited by examiner

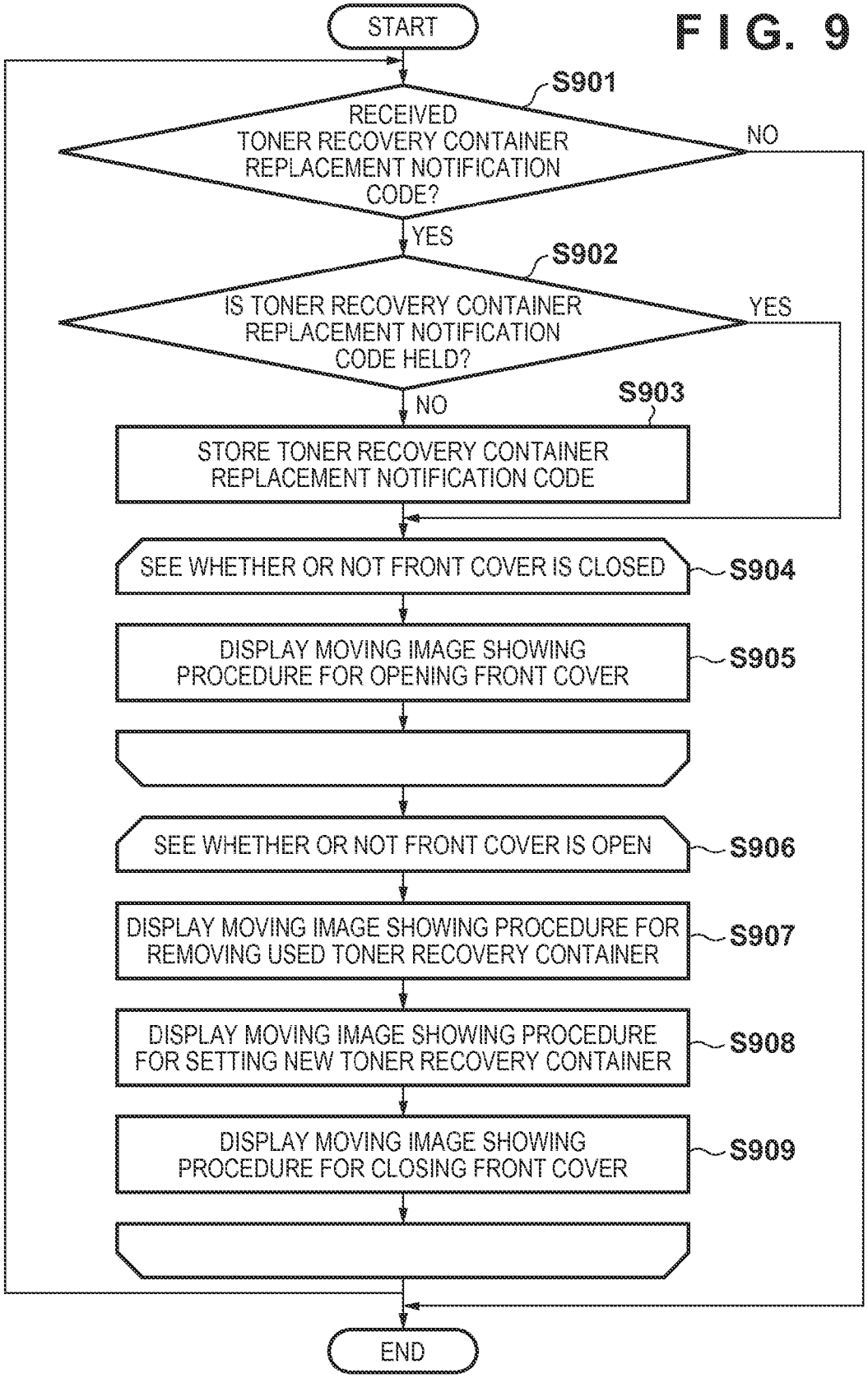
FIG. 9
START
S901
RECEIVED TONER RECOVERY CONTAINER REPLACEMENT NOTIFICATION CODE?
NO
YES
S902
IS TONER RECOVERY CONTAINER REPLACEMENT NOTIFICATION CODE HELD?
YES
NO
S903
STORE TONER RECOVERY CONTAINER REPLACEMENT NOTIFICATION CODE
SEE WHETHER OR NOT FRONT COVER IS CLOSED
S904
DISPLAY MOVING IMAGE SHOWING PROCEDURE FOR OPENING FRONT COVER
S905
SEE WHETHER OR NOT FRONT COVER IS OPEN
S906
DISPLAY MOVING IMAGE SHOWING PROCEDURE FOR REMOVING USED TONER RECOVERY CONTAINER
S907
DISPLAY MOVING IMAGE SHOWING PROCEDURE FOR SETTING NEW TONER RECOVERY CONTAINER
S908
DISPLAY MOVING IMAGE SHOWING PROCEDURE FOR CLOSING FRONT COVER
S909
END

IMAGE FORMING APPARATUS, METHOD FOR CONTROLLING THE SAME, AND STORAGE MEDIUM STORING PROGRAM

BACKGROUND OF THE INVENTION

Field of the Invention

The present invention relates to an image forming apparatus, a method for controlling the same, and a storage medium storing a program.

Description of the Related Art

Conventionally, image forming apparatuses display still images on a display panel of their operation unit in order to prompt a user to perform maintenance operations such as replacement of toner containers or fixing of paper jams. For example, Japanese Patent Laid-Open No. 2003-118881 describes an example in which, if the power is automatically turned off before fixing a jam that has occurred during image formation, proper indication of the jam is displayed when the power is turned on next time.

According to the technique in Japanese Patent Laid-Open No. 2003-118881, jam code held before the power is turned off is used to display proper indication of a jam after the power is turned on again. Such a technique is applicable to replacement of toner containers and the like. Below, an example of replacement of toner containers will be described assuming a specific procedure for replacing toner containers. For example, a case will be assumed in which an image forming apparatus has C (cyan), M (magenta), Y (yellow), and K (black) toner containers, and the remaining amounts of C and M toners are lowered. For example, it is assumed that a user replaces only the C toner container, and performs another operation away from this image forming apparatus while leaving its front cover open. If this states continues for a long time, the image forming apparatus shifts to the sleep state, or is automatically turned off based on the time measured by a timer. It is assumed that, in this sleep state or power-off state, the user turns on the image forming apparatus, thereby starting the image forming apparatus.

At that time, since the front cover of the image forming apparatus is left open, the toner container replacement status in the image forming apparatus is not updated, and, thus, the image forming apparatus will continue to display indication that prompts to replace the C and M toner containers although the C toner container has been already replaced. It is usually expected that, when turning off the image forming apparatus, the user who has replaced the C and M toner containers closes the front cover and then turns off the image forming apparatus. However, if the power is turned off unintentionally by the user, as described above, the front cover may be left open, that is, the toner container replacement may be left uncompleted. In this case, unless the user closes the front cover so as to allow the toner container replacement status stored in the image forming apparatus to be updated, the image forming apparatus cannot display a proper operational procedure for the user.

SUMMARY OF THE INVENTION

An aspect of the present invention is to eliminate the above-mentioned problems with the conventional technology.

The present invention provides a system that changes a moving image showing the user's operational procedure displayed at the time of start of an image forming apparatus, according to the state before the start, thereby preventing operation errors by the user.

The present invention in its first aspect provides an image forming apparatus, comprising: a storage unit configured to store identification code that is issued when a maintenance event for a maintenance of the image forming apparatus occurs, and that is for identifying the maintenance event; a first display control unit configured tosequentially display, based on the identification code stored in the storage unit, an image showing an operational procedure necessary to clear the maintenance event and then an image that prompts to close a cover corresponding to the maintenance event, on a display unit; a deletion unit configured to delete the identification code stored in the storage unit in a case where the maintenance event is cleared; and a second display control unit configured to display an image that prompts to close the cover, without displaying an image showing an operational procedure necessary to clear the maintenance event identified with the identification code, in a case where the identification code is stored in the storage unit at the time of start of the image forming apparatus.

According to the present invention, a moving image showing the user's operational procedure displayed at the time of start of an image forming apparatus is changed according to the state before the start, so that the user can complete toner container replacement that has been left half done, for example, and can perform proper processing.

Further features of the present invention will become apparent from the following description of exemplary embodiments with reference to the attached drawings.

BRIEF DESCRIPTION OF THE DRAWINGS

FIG. 9 is a flowchart illustrating a process that displays a moving image showing the procedure for toner recovery container replacement in the multifunction peripheral.

DESCRIPTION OF THE EMBODIMENTS

Figure 1:
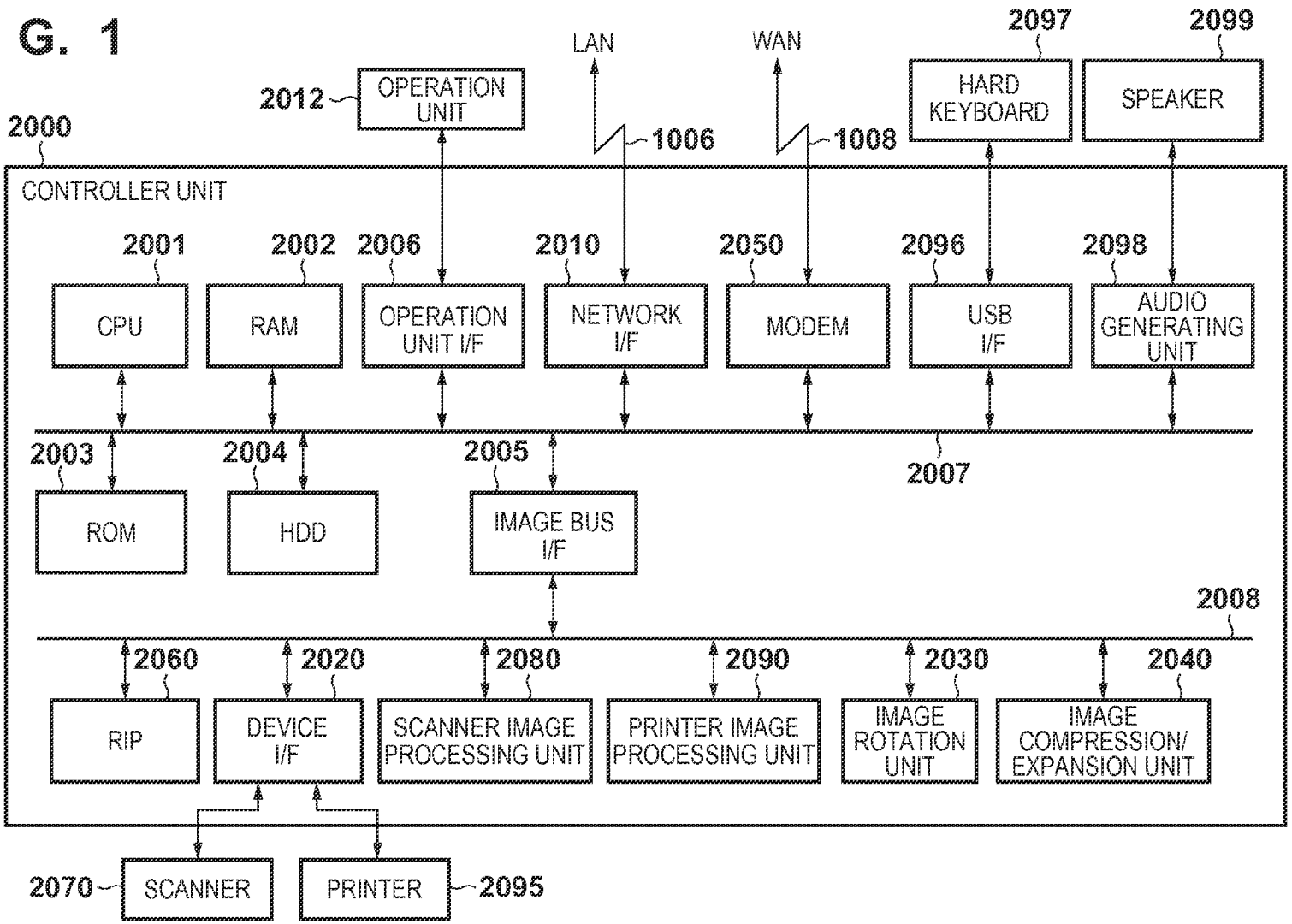
FIG. 1 is a block diagram showing a main configuration of a digital multifunction peripheral.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. The same constituent elements are denoted by the same reference numerals, and a description thereof has been omitted. Note that, although an image forming apparatus will be described using a digital multifunction peripheral as an example in the following embodiments, the present invention is not limited thereto.

FIG. 1 is a block diagram showing a main configuration of a digital multifunction peripheral according to the embodiment of the present invention.

The multifunction peripheral includes a controller unit 2000, and the controller unit 2000 is connected to a scanner 2070, which is an image input device, and a printer 2095, which is an image output device, and is further connected to an operation unit 2012. The controller unit 2000 performs control for implementing a copy function in which image data captured by the scanner 2070 is printed by the printer 2095. Moreover, this controller unit performs control for inputting and outputting image information and device information when being connected to an LAN 1006 or a public line 1008 (WAN).

Specifically, the controller unit 2000 has a CPU 2001, and the CPU 2001 boots an operation system (OS) with a boot program stored in a ROM 2003. On this OS, an application program stored in an HDD (hard disk drive) 2004 is loaded into a RAM 2002 and is executed, so that various processes are performed. The RAM 2002 is used as a work area of the CPU 2001. The RAM 2002 provides the work area and also provides an image memory area for temporarily storing image data. The HDD 2004 stores the application program and the image data described above.

The CPU 2001 is connected via a system bus 2007 to the ROM 2003 and the RAM 2002 and also to an operation unit I/F 2006, a network I/F 2010, a modem 2050, a USB I/F 2096, and an image bus I/F 2005. The operation unit I/F 2006 is an interface with the operation unit 2012 having a touch panel, and outputs image data that is to be displayed on the operation unit 2012, to the operation unit 2012. Furthermore, the operation unit I/F 2006 sends information input by the user using the operation unit 2012, to the CPU 2001. Furthermore, an audio generating unit 2098 is connected via the system bus 2007 to the CPU 2001, and generates audio by generating audio signals based on data received from the CPU 2001 and outputting the generated signals to a loudspeaker 2099.

Moreover, the network I/F 2010 is connected to the LAN 1006, and inputs and outputs information via the LAN 1006 with various units on the LAN 1006. The modem 2050 is connected to the public line 1008, and inputs and outputs information via the public line 1008.

A USB device such as a hard keyboard 2097 can be connected to the USB I/F 2096. When a USB device is connected to the USB I/F 2096, the USB I/F 2096 acquires attributes of the connected USB device by communicating with the USB device following the USB I/F standard, and notifies the CPU 2001 of the acquired attributes. Upon receiving the attribute notification, the CPU 2001 detects that a USB device has been connected or disconnected.

The image bus I/F 2005 connects the system bus 2007 and an image bus 2008 that transfers image data at high speed, and functions as a bus bridge for converting the data format. The image bus 2008 is configured by a PCI bus or IEEE 1394. On the image bus 2008, a raster image processor (hereinafter, "RIP") 2060, a device I/F 2020, a scanner image processing unit 2080, a printer image processing unit 2090, an image rotation unit 2030, and an image compression/expansion (decompression) unit 2040 are provided.

The RIP 2060 is a processor that renders PDL code into a bitmap image. The scanner 2070 and the printer 2095 are connected to the device I/F 2020, and, the device I/F 2020 converts image data between synchronous system and asynchronous system. The scanner image processing unit 2080 corrects, processes, and edits input image data. The printer image processing unit 2090 performs correction, resolution conversion, and the like on print image data according to the printer 2095. The image rotation unit 2030 rotates image data. The image compression/expansion unit 2040 compresses and expands multivalued image data into/from the JPEG format and binary image data into/from the JBIG, MMR, MH, or another format.

Figure 2:
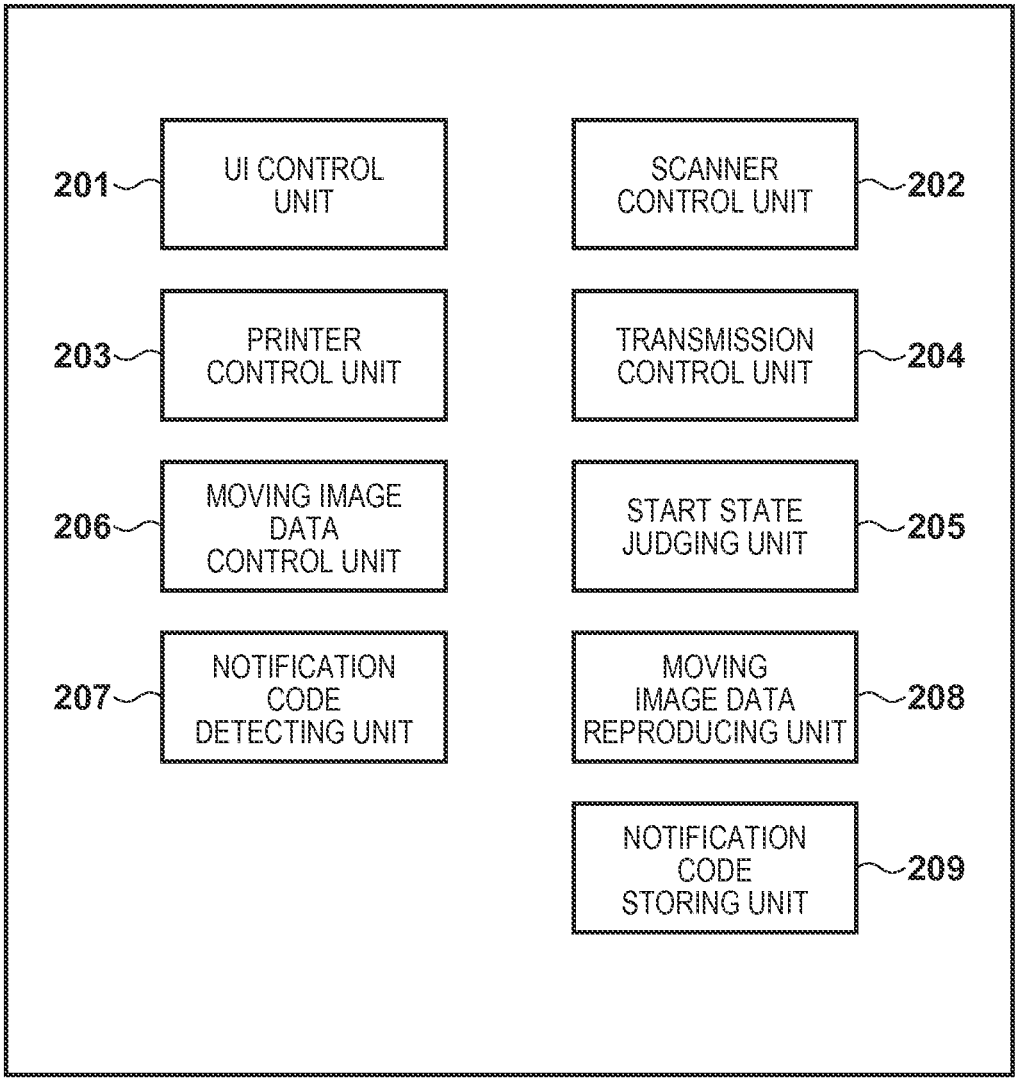
FIG. 2 is a block diagram showing a software configuration for controlling the multifunction peripheral.

FIG. 2 is a block diagram showing a software configuration for controlling the multifunction peripheral according to this embodiment. This software is stored in the ROM 2003. The CPU 2001 performs processes according to this program.

A UI control unit 201 displays an operation screen on the operation unit 2012, and controls a user interface (UI) that accepts user operations. A scanner control unit 202 controls the scanner 2070, and controls a process that reads an original. A printer control unit 203 controls the printer 2095, and controls a printing process based on image data. A transmission control unit 204 controls a process that transmits image data via the network I/F 2010 to a destination specified by the user. Note that this image data may be image data obtained by the scanner 2070 reading an original, image data received from another device and stored in the HDD 2004, or the like. A start state judging unit 205 performs a process that determines the state when the power was turned off, at the time of start (such as power-on) of the multifunction peripheral, according to the flowchart in FIG. 5. A moving image data control unit 206 controls moving image data in the multifunction peripheral. A notification code detecting unit 207 detects notification code issued when maintenance such as replacement of a toner container or replacement of a toner recovery container becomes necessary, as will be described in S401 of FIG. 4 and the like. A moving image data reproducing unit 208 performs a process that displays a moving image, as will be described in S405, S407, and S408 of FIG. 4 and the like. A notification code storing unit 209 stores notification code such as toner container replacement notification code in the HDD 2004, as will be described in S403 of FIG. 4.

Figure 3:
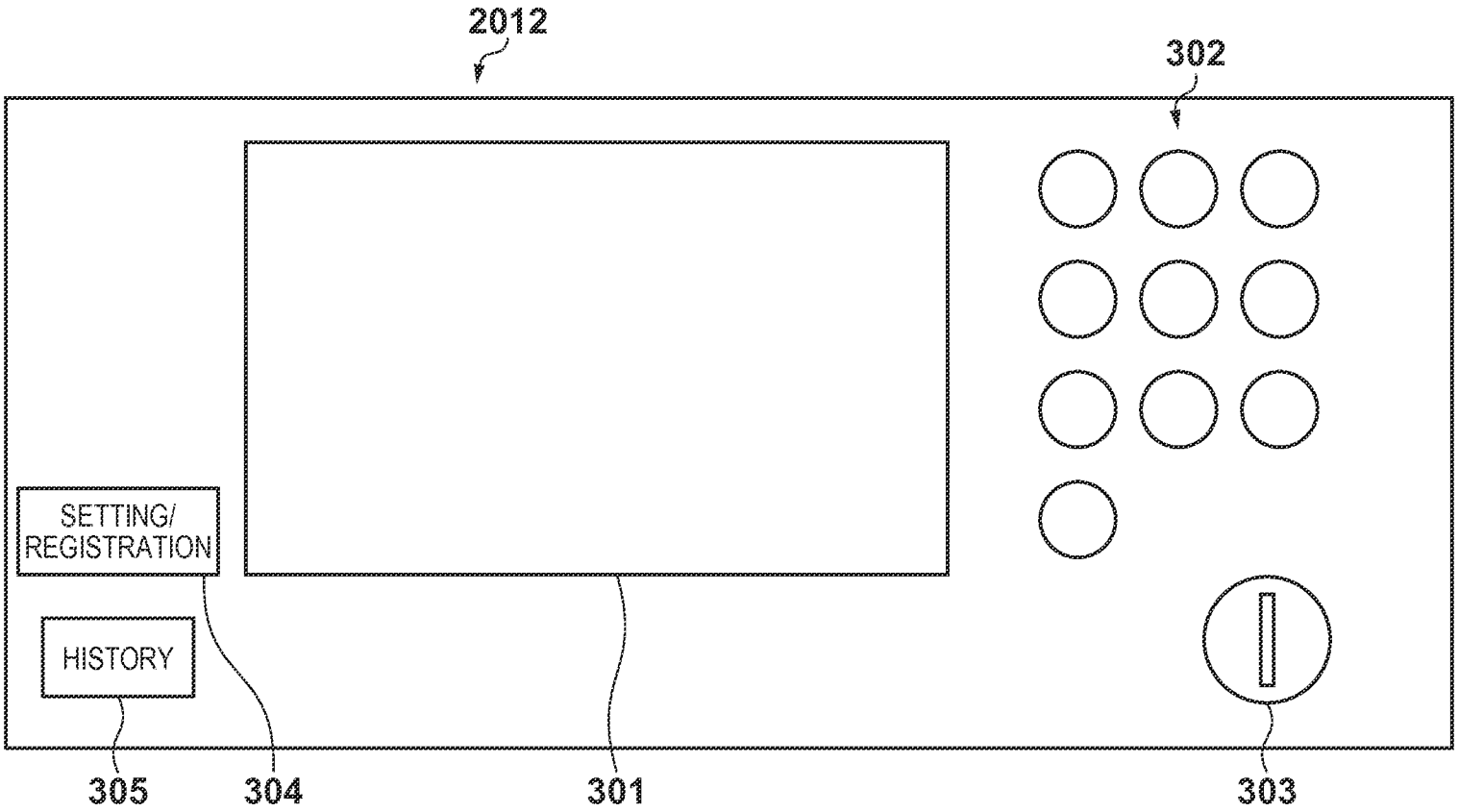
FIG. 3 is a top view of an operation unit of the multifunction peripheral.

FIG. 3 is a top view of the operation unit 2012 in the multifunction peripheral according to this embodiment.

On the operation unit 2012, a display unit 301, a numeric keypad 302, and a start key 303 for giving an instruction to start a job such as copy, facsimile transmission, or email transmission are arranged. When the start key 303 is pressed, the CPU 2001 performs a job execution process. Also, a "setting/registration" button 304 for calling a device setting screen and a "history" button 305 for calling a job history/status screen are arranged. The display unit 301 includes a touch panel function, and an instructed function is executed according to a menu command operated or instructed by the user on the screen of the display unit 301.

Figure 4:
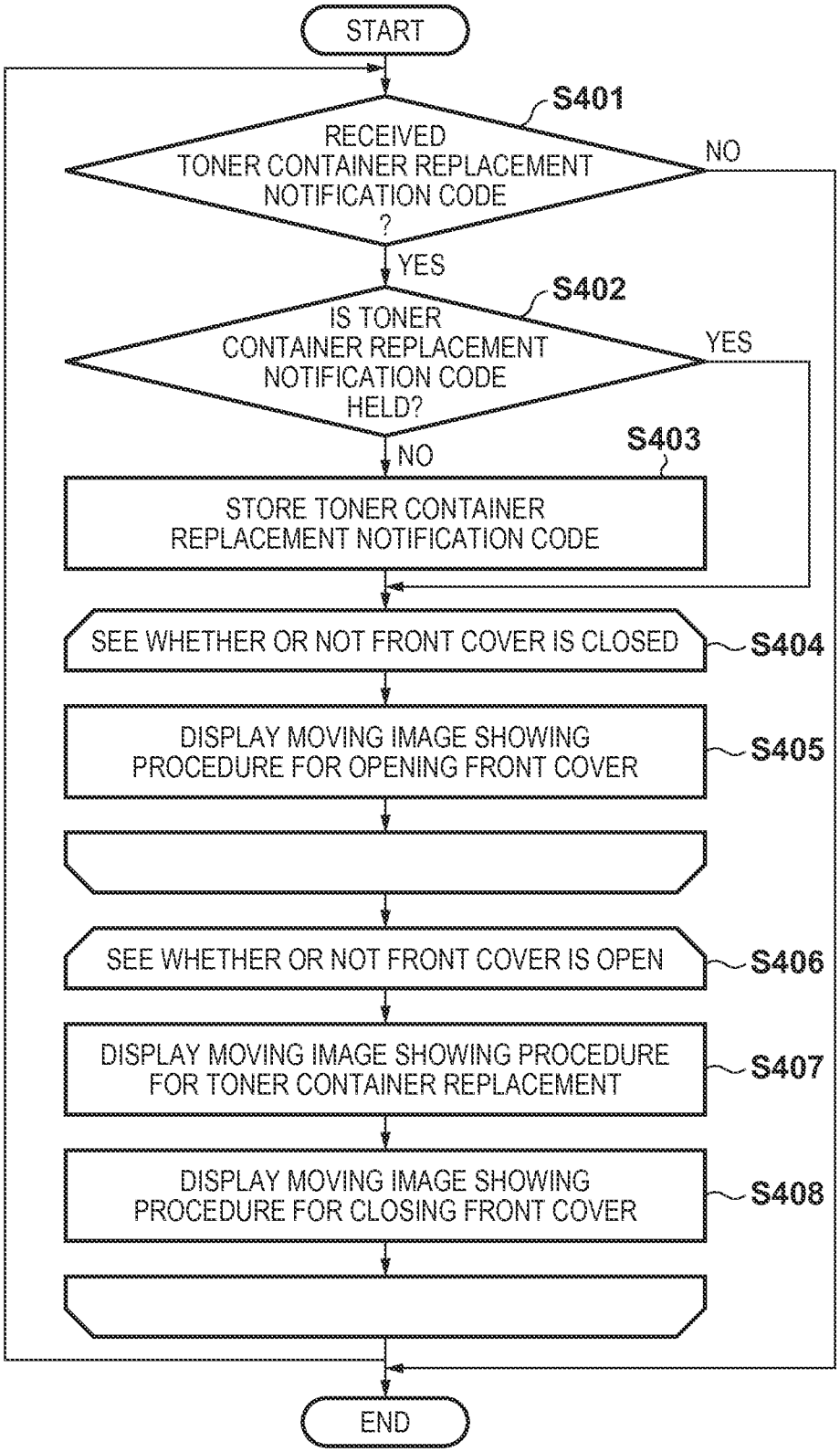
FIG. 4 is a flowchart illustrating a process that displays, as a moving image, a toner container replacement procedure in the multifunction peripheral.

FIG. 4 is a flowchart illustrating a process that displays, as a moving image, a toner container replacement procedure in the multifunction peripheral according to Embodiment 1 of the present invention. Note that the processing shown in this flowchart is implemented by the CPU 2001 executing a program stored in the ROM 2003. The moving images in the embodiments described below are displayed on the display unit 301 of the operation unit 2012.

First, in S401, the CPU 2001 determines whether or not toner container replacement notification code (operation request) issued when there is a request to replace a toner container, that is, when an out-of-toner state occurs, is received. If the CPU 2001 determines in S401 that toner container replacement notification code is not received, the procedure is ended. On the other hand, if it is determined in S401 that toner container replacement notification code is received, the procedure advances to S402, where the CPU 2001 determines whether or not the toner container replacement notification code in that notification is held in the HDD 2004. If the CPU 2001 judges in S402 that the toner container replacement notification code is not held, the procedure advances to S403, where the toner container replacement notification code is stored in the HDD 2004. On the other hand, if it is determined in S402 that the toner container replacement notification code is held, the procedure skips S403 and advances to S404.

In S404, the CPU 2001 determines whether or not the front cover of the multifunction peripheral is closed. Only if the front cover of the multifunction peripheral is closed, S404 and S405 are executed. In S405, in order to prompt the user to open the front cover to expose a toner container attachment location, the CPU 2001 displays a moving image showing the operational procedure thereof on the operation unit 2012. Then, in S404, if the front cover of the multifunction peripheral is opened, the procedure advances to S406.

In S406, the CPU 2001 determines whether or not the front cover of the multifunction peripheral is open, and, only if the front cover is open, S406 to S408 are sequentially executed. In S407, the CPU 2001 displays, on the operation unit 2012, a moving image showing the operational procedure for replacing a toner container that is to be replaced. In S407, if there is only one toner container that is to be replaced, the moving image for the one toner container is displayed, and, if there are a plurality of such toner containers, the moving images for the plurality of toner containers are sequentially displayed. Then, in S408, in order to prompt the user to close the front cover, a moving image showing the operational procedure thereof is displayed. If the toner container is replaced and the front cover of the multifunction peripheral is closed in this manner, the toner container replacement notification code stored in the HDD 2004 is deleted, and the procedure returns to S401. More specifically, upon detecting that the front cover of the multifunction peripheral is closed, an operation that supplies toner from the toner container is started, and the CPU 2001 determines whether or not the out-of-toner state has been cleared. If the CPU 2001 determines that the out-of-toner state has been cleared, the replacement notification code is deleted. Then, if there is no more toner container replacement notification code received in S401, the procedure is ended.

In this manner, with the multifunction peripheral according to Embodiment 1, if there is a request to replace a toner container, in order to replace the toner container, moving images are displayed showing the operational procedure for prompting to open the front cover of the multifunction peripheral and replace the toner container, and, after the replacement, for further prompting to close the front cover. In this manner, the toner container replacement by the user is assisted. Accordingly, the user can properly replace the toner container without being at a loss during the operation.

Figure 5:
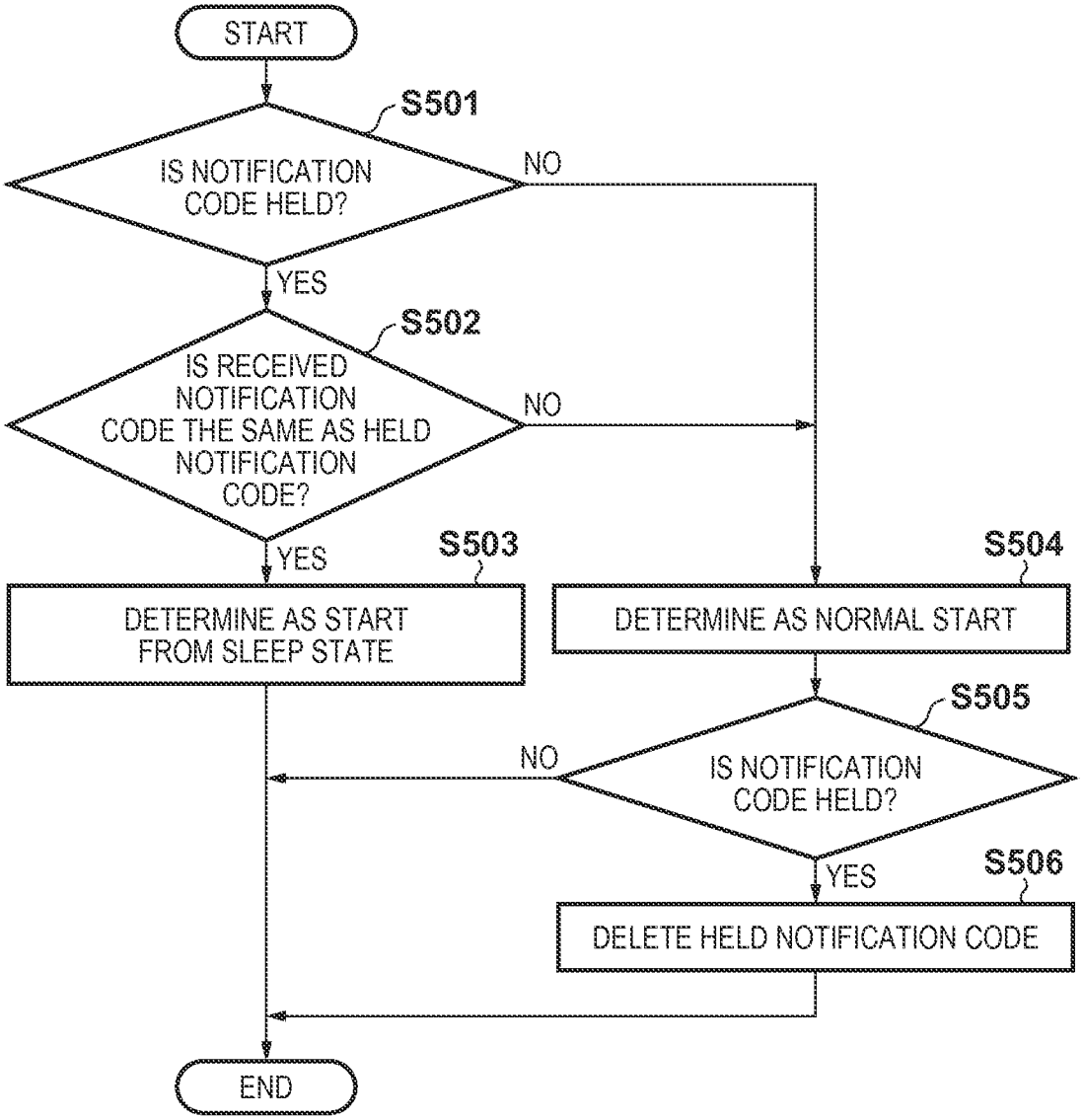
FIG. 5 is a flowchart illustrating processing performed at the time of start of the multifunction peripheral.

FIG. 5 is a flowchart illustrating processing performed at the time of start of the multifunction peripheral according to Embodiment 1. Note that the processing shown in this flowchart is implemented by the CPU 2001 executing a program stored in the ROM 2003. In this example, when the multifunction peripheral that has been in a state such as the power-off state or the sleep state is turned on and started, the state of the multifunction peripheral before the start is determined.

First, in S501, the CPU 2001 determines whether or not notification code such as the above-described toner container replacement notification code is held in the HDD 2004. If it is determined in S501 that the notification code is held, the procedure advances to S502, and, if the notification code is not held, the procedure advances to S504. In S502, the CPU 2001 determines whether or not the notification code received after the start is the same as the held notification code. If they are the same, the procedure advances to S503, and, if they are not the same, the procedure advances to S504. In S503, the CPU 2001 determines that the multifunction peripheral that has been in a power-saving mode is started from the sleep state, and the procedure is ended.

That is to say, for example, in the power-saving mode, the multifunction peripheral may be put into the sleep state unintentionally by the user, and the processing for notification code such as toner container replacement notification code issued therebefore may not be completed. If such processing is not completed, the notification code is still stored in the HDD 2004. Accordingly, if the multifunction peripheral is started in a state in which the processing has not been completed, the same notification code is issued after the start. Accordingly, it seems that, if the held notification code matches the notification code received after the start, the notification code issued before the sleep state is held without being processed. Accordingly, in such a case, it is determined that the start is not normal start but start from the sleep state, for example.

On the other hand, in S504, since the notification code is not held or the notification code issued after the start does not match the held notification code, the CPU 2001 determines that it is normal start, and the procedure advances to S505. That is to say, even if there is held notification code, the processing for the notification code has been completed, and, thus, after the start, notification code that is the same as the held notification code is not issued. Accordingly, in such a case, it is determined that it is normal start. Next, the procedure advances to S505, where the CPU 2001 determines whether or not notification code held before the power is turned off is left. If the notification code is held in S505, the procedure advances to S506, where the held notification code is deleted, and the procedure is ended. Furthermore, if the notification code is not held in S505, the procedure is ended.

In the processing shown in FIG. 5, if the multifunction peripheral is started in a state in which the processing for notification code has been completed, it is determined that it is normal start in which, after the user turns off the power to turn off the multifunction peripheral, the user turns on the power to start the multifunction peripheral. On the other hand, it seems that, if the notification code is held, and notification code that is the same as the held notification code is received after the start, the processing for the held notification code has not been completed. In such a case, for example, it seems that the multifunction peripheral has been turned off in the sleep state or the like, and, thus, it is judged that it is start from the sleep state. Note that examples of the start other than normal start may include start from a state in which the power has been automatically turned off based on a timer or the like.

Figure 6:
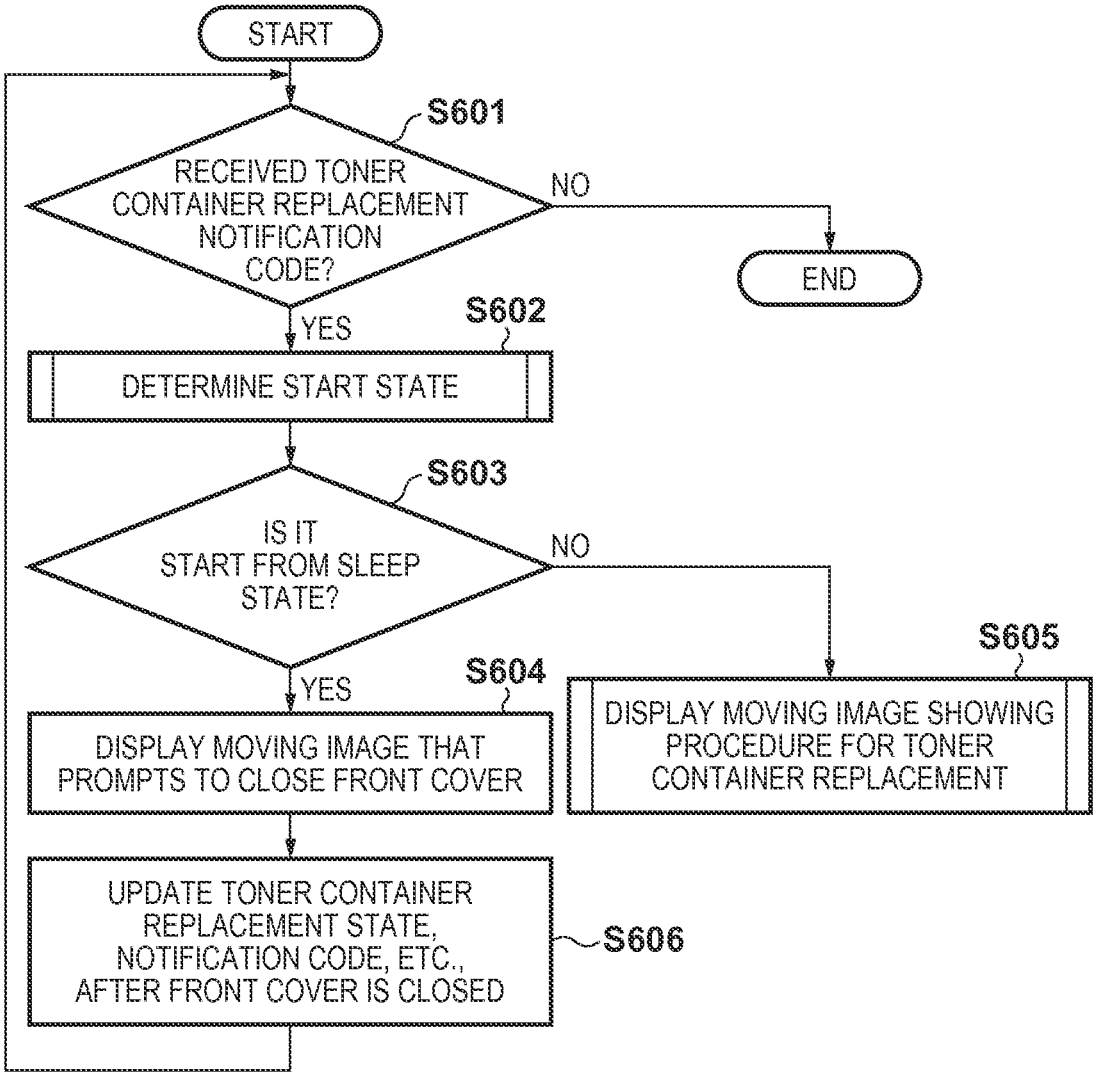
FIG. 6 is a flowchart illustrating processing performed when toner container replacement notification code is received at the time of start of the multifunction peripheral.

FIG. 6 is a flowchart illustrating processing performed when toner container replacement notification code is received at the time of start of the multifunction peripheral according to Embodiment 1. The processing shown in this flowchart is implemented by the CPU 2001 executing a program stored in the ROM 2003. This example shows processing performed in a case in which, at the time of start of the multifunction peripheral, the front cover is left open, and the toner container replacement has not been completed.

In S601, the CPU 2001 judges whether or not toner container replacement notification code is received. If toner container replacement notification code is received in S601, the procedure advances to S602, where it is determined whether it is normal start or start other than normal start (e.g., start from the sleep state). The processing in S602 is performed following the flowchart described in FIG. 5. On the other hand, if the CPU 2001 judges in S601 that toner container replacement notification code is not received, the procedure is ended.

In S603, if the CPU 2001 determines that it is start from the sleep state, the procedure advances to S604, where a moving image that prompts to close the front cover of the multifunction peripheral is displayed. The operation that closes the front cover of the multifunction peripheral is an operation for completing the operational procedure for toner container replacement, and, in this example, a moving image that prompts the user to perform the operation for completing the operational procedure is displayed. Note that, in this step, a moving image showing the operational procedure shown in S408 of FIG. 4 may be displayed. Then, the procedure advances to S606, where, after the front cover of the multifunction peripheral is closed, the CPU 2001 updates the toner container replacement state, the notification code, and the like in the HDD 2004, and the procedure returns to S601. That is to say, upon detecting that the front cover is closed, the CPU 2001 determines whether or not the out-of-toner state has been cleared, and updates the notification code based on the determination result. If the out-of-toner state has been completely cleared, the held notification code is deleted. On the other hand, if the out-of-toner state has not been partially cleared (e.g., if, among the C and M toner containers, replacement of the C toner container has been completed, but replacement of the M toner container has not been completed), the code is updated to notification code for replacement of a toner container in which the out-of-toner state has not been cleared. On the other hand, in S603, if it is normal start, which is not start from the sleep state, the procedure advances to S605, where a moving image for toner container replacement is displayed on the display unit 301 of the operation unit 2012. In S605, the processing similar to that described in S404 to S408 of FIG. 4 is performed. That is to say, a moving image showing the procedure for opening the front cover is displayed, after which, if it is detected that the front cover is opened, a moving image showing the procedure for toner container replacement and then a moving image showing the procedure for closing the front cover are sequentially displayed.

In the flowchart in FIG. 6, in a state in which the toner container replacement has not been completed at the time of start of the multifunction peripheral, if the state before the start is the sleep state, a moving image that prompts to close the front cover is displayed, so that the user is prompted to complete the toner container replacement. The reason for this is that, if the state before the start is the sleep state, and the toner container replacement has not been completed although toner container replacement notification has been issued, it is highly possible that the operation for toner container replacement has been left half done, and the front cover of the multifunction peripheral is open. On the other hand, if the toner container replacement has not been completed at the time of normal start of the multifunction peripheral, it is highly possible that the operation for toner container replacement has not been started, and, thus, a moving image showing the operational procedure for toner container replacement is displayed, so that the user is prompted to perform the toner container replacement.

Note that, in S604, a moving image that prompts to close the front cover is displayed, but this moving image may be displayed, for example, only if a signal of a sensor that detects whether or not the front cover is open indicates that the front cover is open. Furthermore, if the sensor detects that the front cover is not open, the replacement procedure starting from the operation that opens the front cover may be displayed.

Figure 7:
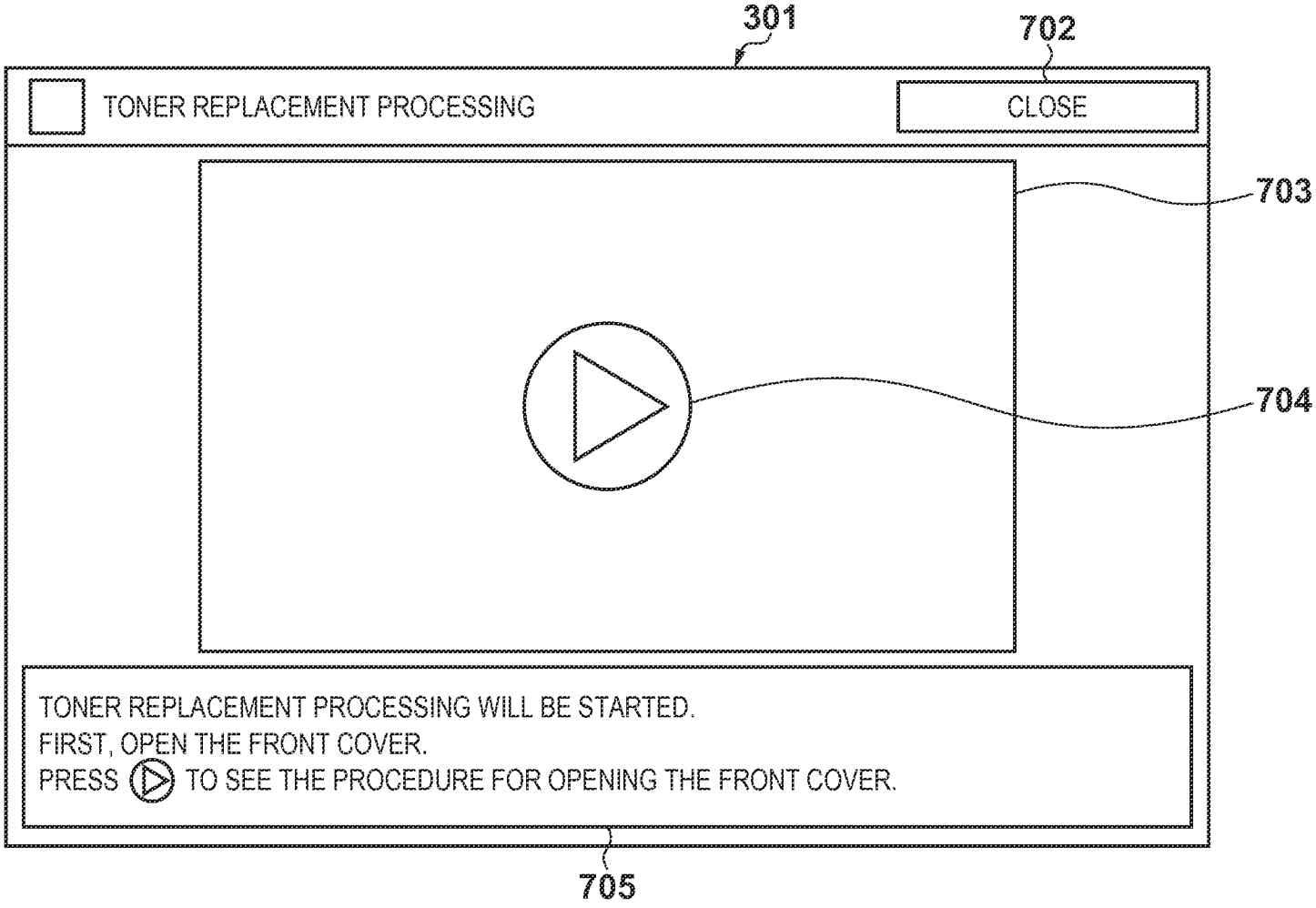
FIG. 7 shows an exemplary screen that displays a moving image showing an operation that replaces a toner container, which is displayed on a display unit of the operation unit in S405 of FIG. 4.

FIG. 7 shows an exemplary screen that displays a moving image showing the operational procedure for toner container replacement, which is displayed on the display unit 301 of the operation unit 2012 in S405 of FIG. 4.

A "close" button 702 is a button for closing this screen. In a moving image display region 703, a moving image showing the operational procedure for toner container replacement is displayed. A reproduction control 704 is used to start display of a moving image in the moving image display region 703. Furthermore, it is used to stop display of a moving image that is being displayed in the moving image display region 703, and is further used to start display of a moving image when being pressed in a state in which the moving image has been paused. In a message display region 705, a message is displayed, and, in this example, a supplemental description regarding the moving image is displayed. Note that, by changing the moving image displayed in the moving image display region 703 and the description displayed in the message display region 705, descriptions of moving images showing different procedures in S407, S408, and the like can be displayed.

Figure 8:
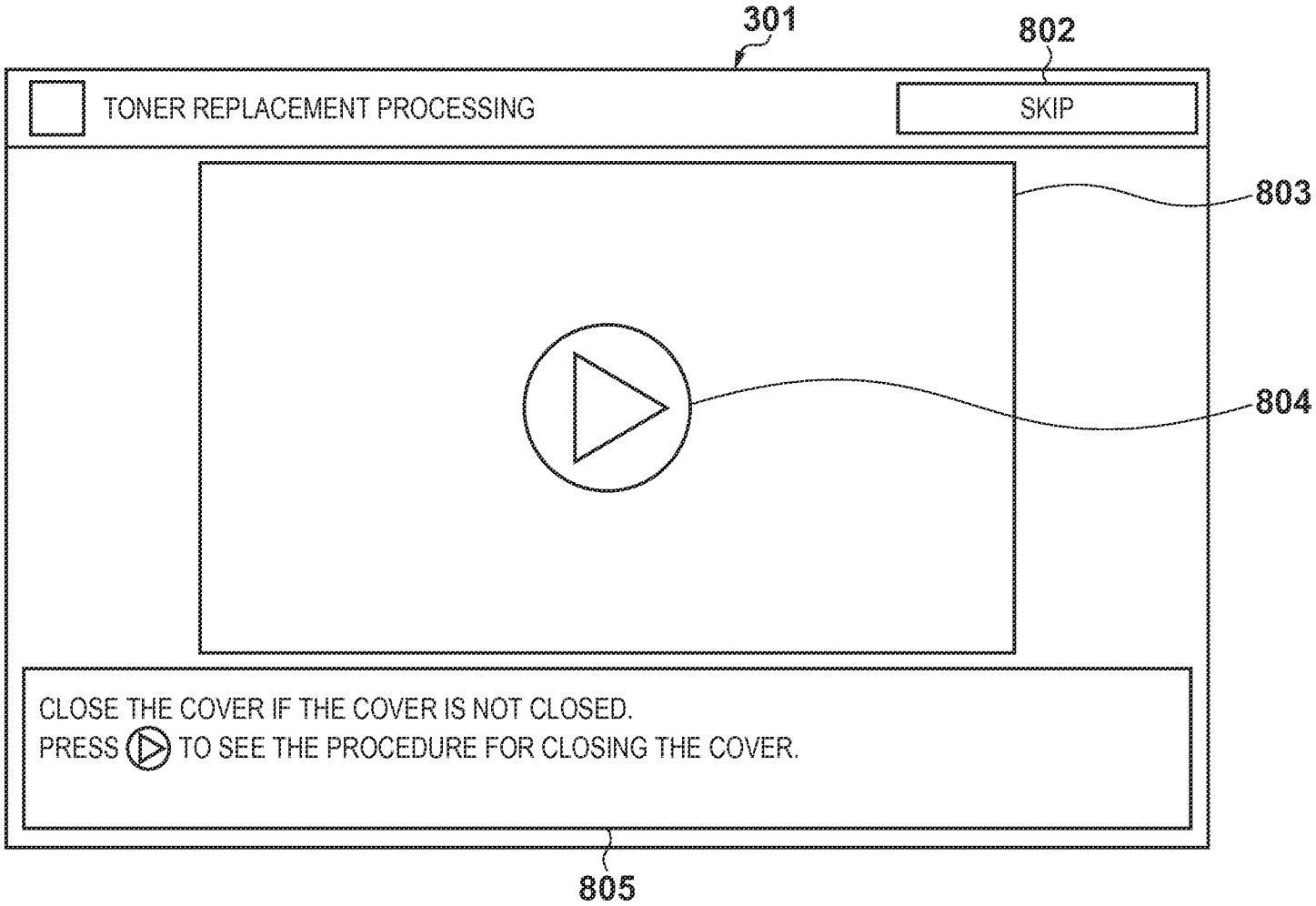
FIG. 8 shows an exemplary screen that displays a moving image showing an operation that closes a front cover, which is displayed on the display unit of the operation unit in S604 of FIG. 6.

FIG. 8 shows an exemplary screen that displays a moving image showing the operational procedure for closing the front cover, which is displayed on the display unit 301 of the operation unit 2012 in S604 of FIG. 6.

A "close" button 802 is a button for closing this screen. A reproduction control 804 is used to start display of a moving image in the moving image display region 703, to stop display of a moving image that is being displayed in the moving image display region 703, and to start reproduction of a moving image when being pressed in a state in which the moving image has been paused. In a message display region 805, a message is displayed, and, more specifically, a supplemental description regarding the moving image displayed in the moving image display region 703 is displayed.

In this manner, according to Embodiment 1, at the time of start of the multifunction peripheral, the state of the multifunction peripheral before the start is determined. Then, in the case of normal start, a moving image showing the user's operational procedure for dealing with the notification code is displayed. That is to say, a moving image that prompts to open a cover corresponding to a maintenance event that has occurred, a moving image showing the operational procedure necessary to clear the maintenance event, and a moving image that prompts to close the cover are sequentially displayed. On the other hand, in the case of start in a state in which the multifunction peripheral has been put into the sleep state or been turned off based on a timer or the like, a moving image showing not the user's operational procedure for dealing with the notification code, but part or the latter half of the operational procedure is displayed. That is to say, the moving image that prompts to open the cover and the moving image showing the operational procedure necessary to clear the maintenance event are not displayed, but the moving image that prompts to close the cover is displayed. The reason for this is that, at the time of start in a state in which the multifunction peripheral has been put into the sleep state or been turned off based on a timer or the like, it is highly possible that the user has performed some operation in order to deal with the notification code, and it may be expected, for example, that the user has forgotten to close the front door. According to this embodiment, the operational procedure more suitable for the state of the multifunction peripheral is displayed, so that the effect of further improving the user operability is achieved.

Embodiment 2

In Embodiment 1 above, a description was given using, as an example, the case in which a moving image showing the procedure for toner container replacement is displayed. Meanwhile, in Embodiment 2, the case will be described in which a moving image showing the procedure for toner recovery container replacement is displayed. Note that the hardware configuration of the multifunction peripheral according to Embodiment 2 is similar to that in Embodiment 1 above, and, thus, a description thereof has been omitted.

FIG. 9 is a flowchart illustrating a process that displays the procedure for toner recovery container replacement in the multifunction peripheral according to Embodiment 2 of the present invention. The processing shown in this flowchart is implemented by the CPU 2001 executing a program stored in the ROM 2003.

First, in S901, the CPU 2001 determines whether or not notification code requesting toner recovery container replacement is received. If there is a request to replace a toner recovery container, the procedure advances to S902, and, otherwise, the procedure is ended. In S902, the CPU 2001 determines whether or not replacement notification code for the toner recovery container that is requested to be replaced is held in the HDD 2004. If the CPU 2001 determines in S902 that the replacement notification code is not held, the procedure advances to S903, where the CPU 2001 stores the replacement notification code in the HDD 2004. On the other hand, if the CPU 2001 determines in S902 that the replacement notification code is held, the procedure skips S903 and advances to S904.

In S904, the CPU 2001 judges whether or not the front cover of the multifunction peripheral is closed, and, only if the front cover is closed, S904 and S905 are executed. In S905, in order to expose a toner recovery container attachment location, the CPU 2001 displays a moving image that prompts to open the front cover of the multifunction peripheral. In this manner, in S904, if the front cover of the multifunction peripheral is opened, the procedure advances to S906. In S906, the CPU 2001 judges whether or not the front cover of the multifunction peripheral is open, and, only if the front cover is open, S906 to S908 are sequentially executed. In S907, a moving image showing the procedure for removing a used toner recovery container is displayed. Subsequently, in S908, a moving image showing the procedure for setting a new toner recovery container is displayed. Then, the procedure advances to S909, where the CPU 2001 displays a moving image showing the procedure for closing the front cover of the multifunction peripheral. In this manner, if the user replaces the toner recovery container with a new toner recovery container, and closes the front cover of the multifunction peripheral, the replacement notification code held in the HDD 2004 in S902 is deleted, and the procedure returns to S901. Then, if there is no more notification code requesting toner recovery container replacement received in S901, the procedure is ended.

In this manner, with the multifunction peripheral according to Embodiment 2, if there is a request to replace a toner recovery container, in order to replace the toner recovery container, moving images can be displayed showing the procedure for opening the front cover of the multifunction peripheral and removing the toner recovery container, and then replacing the toner recovery container with a new toner recovery container. Also, after a new toner recovery container has been set, a moving image that prompts to close the front cover is displayed to assist the user in the toner recovery container replacement. Accordingly, the user can properly replace the toner recovery container without being at a loss during the operation.

Figure 10:
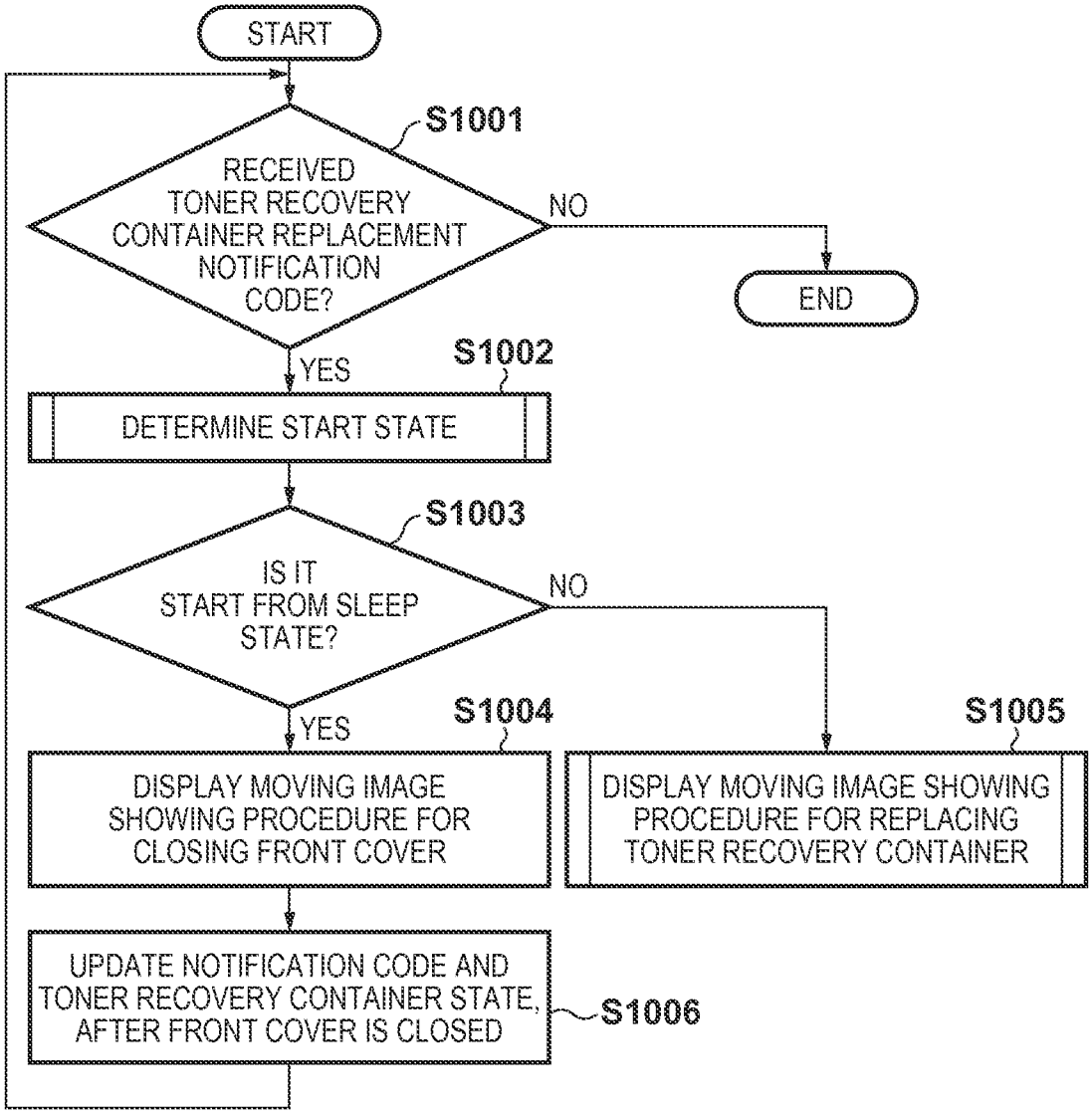
FIG. 10 is a flowchart illustrating processing performed at the time of start of the multifunction peripheral.

FIG. 10 is a flowchart illustrating processing performed at the time of start of the multifunction peripheral according to Embodiment 2. Note that the processing shown in this flowchart is implemented by the CPU 2001 executing a program stored in the ROM 2003. In this example, when the multifunction peripheral that has been in the power-off state or the sleep state is turned on and started, the state of the multifunction peripheral before the start is determined, and display of a moving image showing the procedure for toner recovery container replacement is switched.

First, in S1001, the CPU 2001 determines whether or not toner recovery container replacement notification code is received. If replacement notification code is received, the procedure advances to S1002, where the state before the start is determined, and then the procedure advances to S1003. The processing in S1002 is the same as the processing in the flowchart described in FIG. 5. On the other hand, if the CPU 2001 determines in S1001 that toner recovery container replacement notification code is not received, the procedure is ended.

In S1003, the CPU 2001 determines whether or not it is start from the sleep state, that is, start other than the normal start. In S1003, if it is start other than the normal start, the procedure advances to S1004, where the CPU 2001 displays a moving image that prompts to close the front cover. Also in this case, the operation that closes the front cover is an operation for completing the operational procedure for toner recovery container replacement. Then, the procedure advances to S1006, where, after the front cover is closed, the CPU 2001 updates the notification code and the toner recovery container replacement state, and the procedure returns to S1001. That is to say, upon detecting that the front cover is closed, the CPU 2001 determines whether or not the toner recovery container replacement has been completed, and updates the notification code based on the determination result. On the other hand, if the CPU 2001 determines in S1003 that it is normal start, the procedure advances to S1005, where the CPU 2001 displays a moving image showing the operational procedure for toner recovery container replacement. The processing in S1005 is similar to that in the flowchart described in FIG. 9.

Note that an exemplary configuration of the screen that displays a moving image in Embodiment 2 is the same as that described with reference to FIG. 7, and, thus, a description thereof has been omitted.

In this manner, according to Embodiment 2, at the time of start of the multifunction peripheral, the state before the start is determined, and, if it is normal start, a moving image showing the procedure for toner recovery container replacement is displayed. On the other hand, if it is start other than normal start (e.g., start from the sleep state), part or the latter half of the procedure for toner recovery container replacement is displayed, so that the user operability can be further improved.

Note that, in S1004, a moving image that prompts to close the front cover is displayed, but this moving image may be displayed, for example, only if a signal of a sensor that detects whether or not the front cover is open indicates that the front cover is open. Furthermore, if the sensor detects that the front cover is not open, a moving image showing the procedure for toner recovery container replacement starting from the operation that opens the front cover may be displayed.

Embodiment 3

In Embodiment 2 above, a description was given using, as an example, the case in which a moving image showing the procedure for toner recovery container replacement is displayed. Meanwhile, in Embodiment 3, the case will be described in which a moving image showing the procedure for replacing a staple unit for stapling in the multifunction peripheral is displayed. Note that the hardware configuration of the multifunction peripheral according to Embodiment 3 is similar to that in Embodiment 1 above, and, thus, a description thereof has been omitted.

Figure 11:
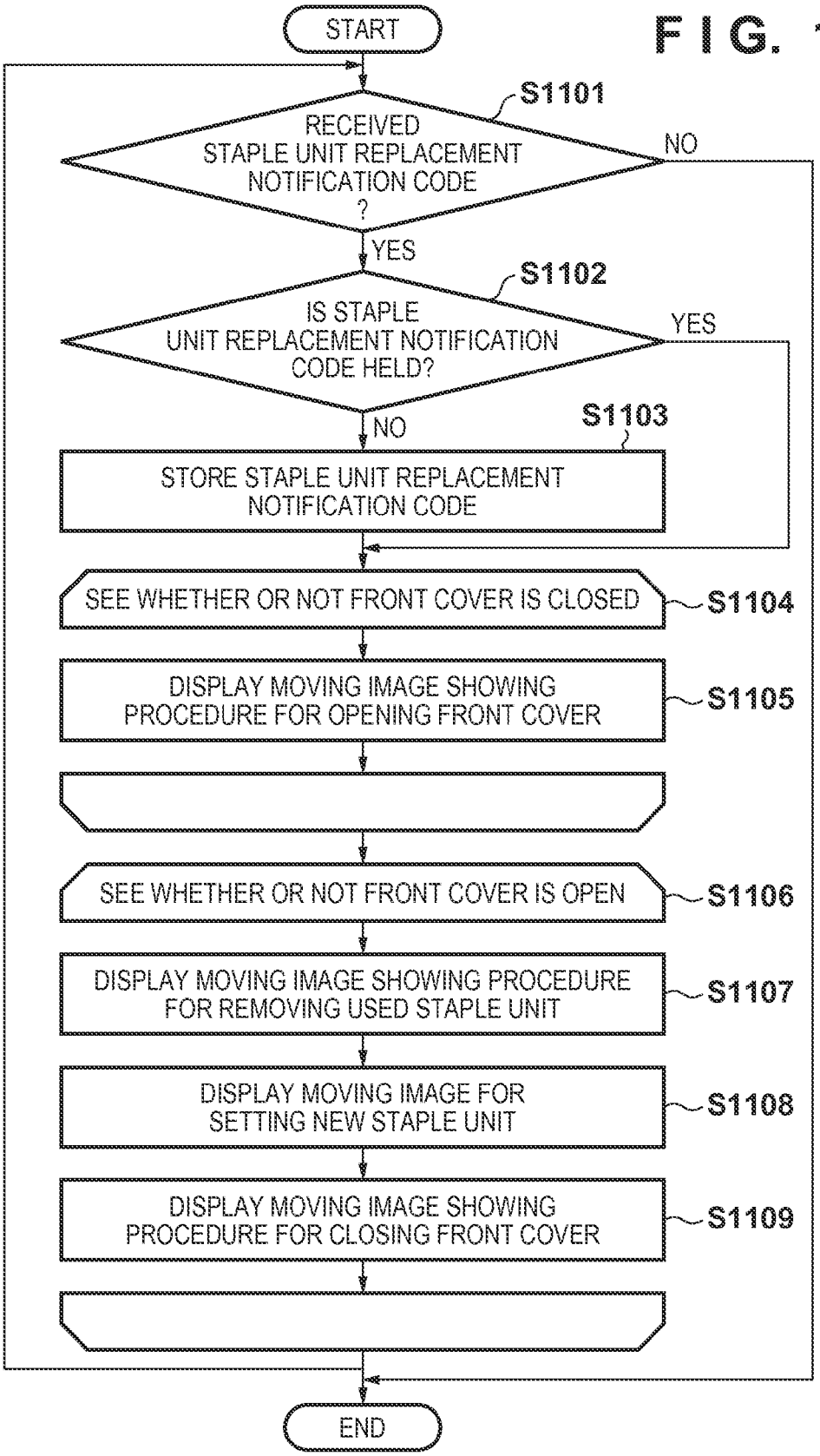
FIG. 11 is a flowchart illustrating a process that displays the procedure for replacing a staple unit for stapling in the multifunction peripheral.

FIG. 11 is a flowchart illustrating a process that displays the procedure for replacing a staple unit for stapling in the multifunction peripheral according to Embodiment 3 of the present invention. The processing shown in this flowchart is implemented by the CPU 2001 executing a program stored in the ROM 2003.

First, in S1101, the CPU 2001 determines whether or not staple unit replacement notification code is received. If replacement notification code is received, the procedure advances to S1102, where the CPU 2001 determines whether or not the staple unit replacement notification code is held in the HDD 2004. If the CPU 2001 determines in S1102 that the replacement notification code is not held, the procedure advances to S1103, where the CPU 2001 stores the replacement notification code in the HDD 2004, and the procedure advances to S1104. On the other hand, if the CPU 2001 determines in S1102 that the replacement notification code is held, the procedure skips S1103 and advances to S1104.

In S1104, the CPU 2001 judges whether or not the front cover of the multifunction peripheral is closed, and, only if the front cover is closed, S1104 and S1105 are executed. In S1105, in order to prompt to open the front cover of the multifunction peripheral, the CPU 2001 displays a moving image showing the operational procedure thereof. If the front cover is opened in this manner, the procedure advances to S1106, where the CPU 2001 judges whether or not the front cover of the multifunction peripheral is open, and, only if the front cover is open, S1106 to S1108 are sequentially executed. In S1107, the CPU 2001 displays a moving image showing the procedure for removing a used staple unit. Subsequently, in S1108, the CPU 2001 displays a moving image showing the procedure for setting a new staple unit. Next, in S1109, the CPU 2001 displays a moving image showing the procedure for closing the front cover of the multifunction peripheral.

In this manner, with the multifunction peripheral according to Embodiment 3, if there is a request to replace a staple unit for stapling, in order to replace the staple unit, the procedure for opening the front cover of the multifunction peripheral and removing the staple unit, and then replacing the staple unit with a new staple unit can be displayed. Also, after a new staple unit has been set, a moving image that prompts to close the front cover is displayed to assist the user in the staple unit replacement. Accordingly, the user can properly replace the staple unit without being at a loss during the operation.

Figure 12:
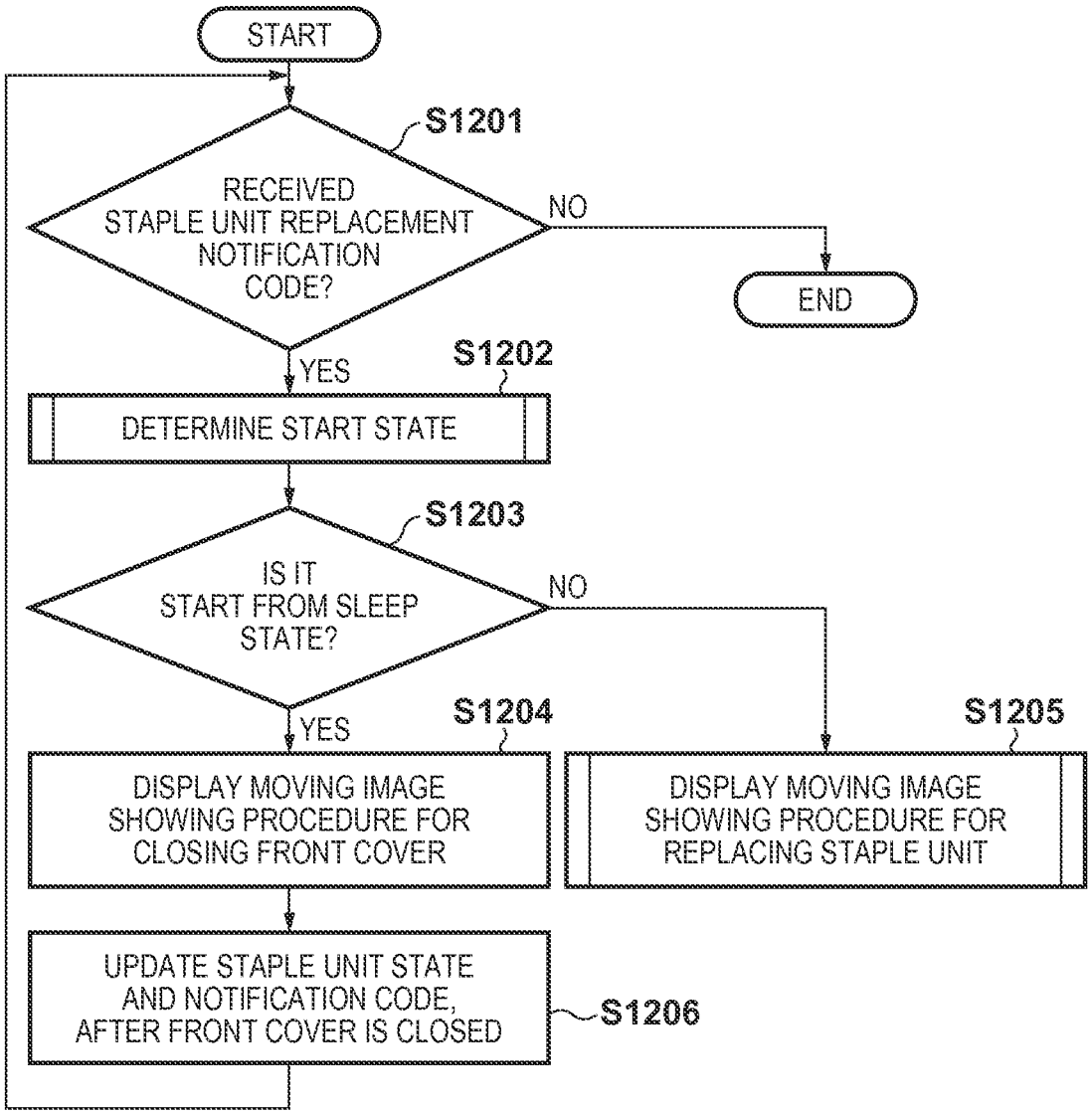
FIG. 12 is a flowchart illustrating processing performed at the time of start of the multifunction peripheral.

FIG. 12 is a flowchart illustrating processing performed at the time of start of the multifunction peripheral according to Embodiment 3. Note that the processing shown in this flowchart is implemented by the CPU 2001 executing a program stored in the ROM 2003. In this example, when the multifunction peripheral that has been in the power-off state or the sleep state is turned on and started, the state of the multifunction peripheral before the start is determined, and display of a moving image showing the procedure for staple unit replacement is switched. The processing shown in this flowchart is implemented by the CPU 2001 executing a program stored in the ROM 2003.

In S1201, the CPU 2001 determines whether or not staple unit replacement notification code is received. If replacement notification code is received, the procedure advances to S1202, and, otherwise, the procedure is ended. In S1202, the CPU 2001 determines the state before the start. The processing in S1202 is similar to that in the flowchart described in FIG. 5.

Next, the procedure advances to S1203, where the CPU 2001 judges whether or not it is normal start or start from the sleep state. If it is determined in S1203 that it is start from the sleep state, the procedure advances to S1204, where the CPU 2001 displays a moving image that prompts to close the front cover. The operation that closes the front cover is an operation for completing the operational procedure for staple unit replacement. Then, the procedure advances to S1206, where, after the front cover is closed, the CPU 2001 updates the staple unit replacement state and the notification code, and the procedure returns to S1201. That is to say, upon detecting that the front cover is closed, the CPU 2001 determines whether or not staple unit replacement has been completed, and updates the notification code based on the determination result. On the other hand, if it is determined in S1203 that it is normal start, the procedure advances to S1205, where a moving image showing the operational procedure for staple unit replacement is displayed. The processing in S1205 is similar to that in the flowchart described in FIG. 11.

Note that, in S1204, a moving image that prompts to close the front cover is displayed, but this moving image may be displayed, for example, only if a signal of a sensor that detects whether or not the front cover is open indicates that the front cover is open. Furthermore, if the sensor detects that the front cover is not open, a moving image showing the procedure for staple unit replacement starting from the operation that opens the front cover may be displayed.

Note that an exemplary configuration of the screen that displays a moving image in Embodiment 3 is the same as that described with reference to FIG. 7, and, thus, a description thereof has been omitted.

In this manner, according to Embodiment 3, at the time of start of the multifunction peripheral, the state before the start is determined, and, if it is normal start, a moving image showing the procedure for staple unit replacement is displayed. On the other hand, if it is start other than normal start (e.g., start from the sleep state), part or the latter half of the procedure for staple unit replacement is displayed, so that the user operability can be further improved.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-261629, filed Nov. 29, 2012, which is hereby incorporated by reference herein in its entirety.

What is claimed is:

1. An image forming apparatus, comprising:

a detection unit configured to detect an identification code that is issued when a maintenance event of the image forming apparatus occurs and that indicates information of the maintenance event;

a storage unit configured to store the identification code detected by the detection unit;

a deletion unit configured to delete the identification code stored in the storage unit according to the maintenance event being created;

a determination unit configured to determine whether a same identification code as the identification code detected by the detection unit when the image forming apparatus is started up is stored in the storage unit; and a display control unit configured to, in a case where the determination unit determines that the same identification code is stored in the storage unit, display on a display unit an image showing an operation which is required for completing an operation for clearing the occurred maintenance event and, in a case where the determination unit determines that the same identification code is not stored in the storage unit, display on the display unit an image showing the operation for clearing the occurred maintenance event.

2. The image forming apparatus according to claim 1, wherein in a case where the determination unit determines that the same identification code is stored in the storage unit, the display control unit skips displaying an image for starting the operation.

3. The image forming apparatus according to claim 1, wherein the maintenance event includes at least one of occurrence of a request to replace a toner container, occurrence of a request to replace a toner recovery container, and occurrence of a request to replace a staple unit for stapling.

4. The image forming apparatus according to claim 1, wherein in a case where the determination unit determines that the identification code detected by the detection unit when the image forming apparatus is started up is the same as the identification code which has been stored in the storage unit, the display control unit displays on the display unit the image showing the operation which is required for completing the operation for clearing the occurred maintenance event, and wherein in a case where the determination unit determines that the identification code detected by the detection unit when the image forming apparatus is started up is not the same as the identification code which has been stored in the storage unit, the display control unit displays on the display unit an image showing the operation for clearing the occurred maintenance event.

5. The image forming apparatus according to claim 1, wherein the determination unit further determines that the image forming apparatus transitioned to a power-saving mode prior to the start-up without completing the operation necessary to clear the maintenance event in a case where it is determined that the same identification code is stored in the storage unit, and determines that the image forming apparatus is started up from a powered off state in a case where it is determined that the same identification code is not stored in the storage unit.

6. The image forming apparatus according to claim 1, wherein the operation which is required tor completing the operation for clearing the occurred maintenance event is to close a cover corresponding to where the maintenance event occurred.

7. The image forming apparatus according to claim 1, wherein the display control unit displays the image showing the operation, in a moving image.

8. The image forming apparatus according to claim 2, wherein the image for starting the operation is for opening a cover of the image forming apparatus.

9. The image forming apparatus according to claim 8, wherein the display control unit displays an image for closing the cover.

10. The image forming apparatus according to claim 9, wherein, the display control unit skips displaying the image for starting the operation, in a case where the image forming apparatus transitioned to a power-saving mode prior to the start-up without completing the operation for clearing the occurred maintenance event, and wherein the power-saving mode is a mode in which a power of the image forming apparatus is reduced after elapse of a predetermined time period counted by a timer.

11. The image forming apparatus according to claim 9, wherein, when the cover is closed, whether or not the maintenance event has been cleared is determined.

12. A method for controlling an image forming apparatus, comprising:

detecting an identification code that is issued when a maintenance event of the image forming apparatus occurs and that indicates information of the maintenance event;

storing the detected identification code;

deleting the stored identification code according to the maintenance event being cleared;

determining whether a same identification code as the identification code detected when the image forming apparatus is started up is stored; and in a case where the same identification code is stored, displaying an image showing an operation which is required for completing an operation for clearing the occurred maintenance event, and in a case where the same identification code is not store, displaying an image showing the operation for clearing the occurred maintenance event.

13. A computer-readable storage medium storing a program for causing a computer to execute a method comprising:

detecting an identification code that is issued when a maintenance event of the image forming apparatus occurs, and that indicates information of the maintenance event;

storing the detected identification code;

deleting the stored identification code according to the maintenance event being cleared;

determining whether a same identification code as the identification code detected when the image forming apparatus is started up is stored; and in a case where the same identification code is stored, displaying an image showing an operation which is required for completing an operation for clearing the occurred maintenance event, and in a case where the same identification code is not stored, displaying an image showing the operation for clearing the occurred maintenance event.

* * * * *